US005729931A

United States Patent [19]

Wade

[11] Patent Number: 5,729,931

[45] Date of Patent: Mar. 24, 1998

[54] GUTTER GUARD FOR CORRUGATED ROOFING

[76] Inventor: Rodney George Wade, 17 Wongawallen Dr., Upper Coomera, Queensland 4210, Australia

[21] Appl. No.: 747,179

[22] Filed: Nov. 12, 1996

[51] Int. Cl.[6] ..... E04D 13/06

[52] U.S. Cl. ..... 52/12; 52/11; 248/48.2

[58] Field of Search ..... 52/11, 12, 13; 248/48.2, 48.1

[56] References Cited

U.S. PATENT DOCUMENTS

| | | | |
|---|---|---|---|
| 3,295,264 | 1/1967 | Olson | 52/12 |
| 3,297,285 | 1/1967 | Simmons | 248/48.1 |
| 3,864,237 | 2/1975 | Nelems | 52/12 X |
| 4,631,875 | 12/1986 | Olson | 52/12 |
| 4,936,061 | 6/1990 | Palma | 52/11 X |
| 5,072,551 | 12/1991 | Manoogian, Jr. | 52/12 |
| 5,092,086 | 3/1992 | Rognsvoog, Sr. | 52/12 |
| 5,257,482 | 11/1993 | Sichel | 52/12 |

FOREIGN PATENT DOCUMENTS

| | | | |
|---|---|---|---|
| B-38785 | 5/1993 | Australia | E04D 13/06 |
| 2912816 | 10/1980 | Germany | 52/11 |

*Primary Examiner*—Carl D. Friedman
*Assistant Examiner*—Winnie S. Yip

[57] ABSTRACT

A mesh (10) and flashing (11) for use with a roof guttering to prevent leaves and debris from entering the guttering. The mesh is adapted to overlie the guttering and a part of a corrugated roof. The flashing fits flush against the roof and includes a plurality of tongue extensions (16). Each of the tongue extensions fits between a corrugation of the roof.

18 Claims, 2 Drawing Sheets

GUTTER GUARD FOR CORRUGATED ROOFING

BACKGROUND OF THE INVENTION

THIS INVENTION relates to means for preventing leaves and debris from passing into roof gutterings, and and is a modification or improvement of the gutter guard arrangement which is the subject of my Australian Patent No. 665419 (AU-B-38785/93). The invention is particularly concerned with gutter guards for use with corrugated sheet roofing.

BRIEF DESCRIPTION OF THE PRIOR ART

In Australian Patent AU-B 38785 patent, the description with respect to FIGS. 3 and 4 discloses a mesh which is held over the gutter opening by the use of mechanical fasteners and a corrugated strip of metal which clamps the mesh between it and the corrugated sheet roofing. The mesh could be manufactured from metal or plastics material. However when metal mesh, such as steel mesh, was used it was found to be impossible to produce a profile in the mesh which progressed the mesh from the corrugated sheet roofing profile to the flat gutter edge profile without becoming unsightly and losing effectiveness due to bulges and folds being produced on the flat edge and through which debris could pass. In essence, it was not practical to use a mesh manufactured from metal.

The inability to use a metal mesh detracted from the usefulness of the product as a fire resistant product. This is of particular concern in fire prone regions of Australia where it is desirable to have as many features of a home as possible fire proofed.

Another problem with the aforementioned gutter guard arrangement is that at the interface between the corrugated metal fixing strip and the sheet roofing materials, a lip was formed which acted as a snag against which debris could be caught. The build-up of debris at this point over time detracted from the aesthetic characteristics of the arrangement.

OBJECT OF THE INVENTION

It is therefore an object of the present invention to provide a gutter guard arrangement for use with sheet metal corrugated roofing, which overcomes the aforementioned disadvantages of existing gutter guard arrangements.

SUMMARY OF THE INVENTION

According to the present invention, there is provided an arrangement for preventing leaves and debris from passing into the guttering of a corrugated sheet metal roof, said arrangement comprising a strip of mesh fitted with a flashing along one edge, which mesh is adapted to overlie the roof guttering opening and a lower section of the corrugated sheet metal roof, and which flashing is adapted to butt up against the corrugated sheet metal roof at a location spaced from the edge of the roof, said flashing characterised by a plurality of tongue extensions projecting from a longitudinal edge thereof, each said tongue extension being adapted to extend between respective adjacent ridge corrugations in the corrugated sheet metal from the peak of the ridges to the bottom of the channel therebetween at an inclined angle such that the interface between the tip of each tongue extension and the bottom of the channel is a smooth large obtuse angle which does not significantly impede the flow of rainwater with entrained leaves and debris, thereover.

DETAILED DESCRIPTION OF THE INVENTION

Suitably, the mesh is fabricated from metals such as stainless or galvanized steels or irons, aluminium, copper, brass or like alloys, which are optionally powder coated, if appropriate. Plastics materials such as polyethylene may also be used however they are not preferred. Generally for most applications the mesh aperture size will be of the region of about 3 mm×3 mm to 15 mm×15 mm, most preferably approximately 6 mm×6 mm.

The flashing is suitably manufactured from the same material as the corrugated sheet metal roof which is usually 0.4 mm high tensile steel or aluminium. The flashing will generally be such as to match the roof and may be plain galvanized or colour bonded to the same colour as the corrugated sheet metal roof. Preferably, the flashing is secured to the corrugated sheet metal roof by the use of fixing elements such as screws, pop rivets, or nails which extend through the flashing, mesh and selected ridges of the corrugated sheet roofing.

A longitudinal fold may be formed in the flashing which is parallel to the edge of the corrugated sheet metal roof. The fold is suitably located where the fixing elements are to be inserted and it is designed to produce a low level ridge running the length of the flashing so that when it is fixed in position, the fixing elements will tend to push the ridge down causing the tips of the flashing tongues to be biased against the bottom of the channels between adjacent corrugations in the roof, thereby forming an effective seal with the roof.

The mesh at the gutter edge is preferably held firm against the gutter edge by virtue of the tension exerted by the flashing when it is secured to the corrugated sheet metal roof. That is, since the uppermost portion of the gutter edge is always located above the lowermost portion of the corrugated sheet metal roof, there is a natural downward pressure transmitted by the mesh against the gutter edge. There is consequently generally no essential requirement for additional mechanical fasteners. However, should the building specification call for permanent fixtures, screws, rivets or snap-in fixings can be fitted through the mesh into holes drilled in the lip of the gutter, or the mesh can be fixed using stainless steel or like clips which urge the mesh against the lip of the gutter. Generally, for internal roll edge gutters, the mesh will wrap under the rolled edge and be retained therein. For external roll edge gutters, clips are normally a preferment although a wrapping arrangement can also be used.

The flashing and mesh can be joined together by fitting an edge strand of the mesh over a plurality of indents pressed from the face of the flashing adjacent a longitudinal edge thereof. If necessary these indents can be hand pressed over the strand to prevent removal thereof. Alternatively, the flashing and mesh can be joined in situ, that is, when it is being placed on the roof.

Another aspect of the invention concerns the flashing and mesh combination per se and as the flashing can be sold separately from the flashing, a still further aspect of the invention concerns the profiled flashing per se.

DESCRIPTION OF THE DRAWINGS

A preferred embodiment of the invention will now be described with reference to the accompanying drawings, in which.

In all of the drawings, like reference numerals refer to like parts.

DESCRIPTION OF PREFERRED EMBODIMENT

Figure 1:
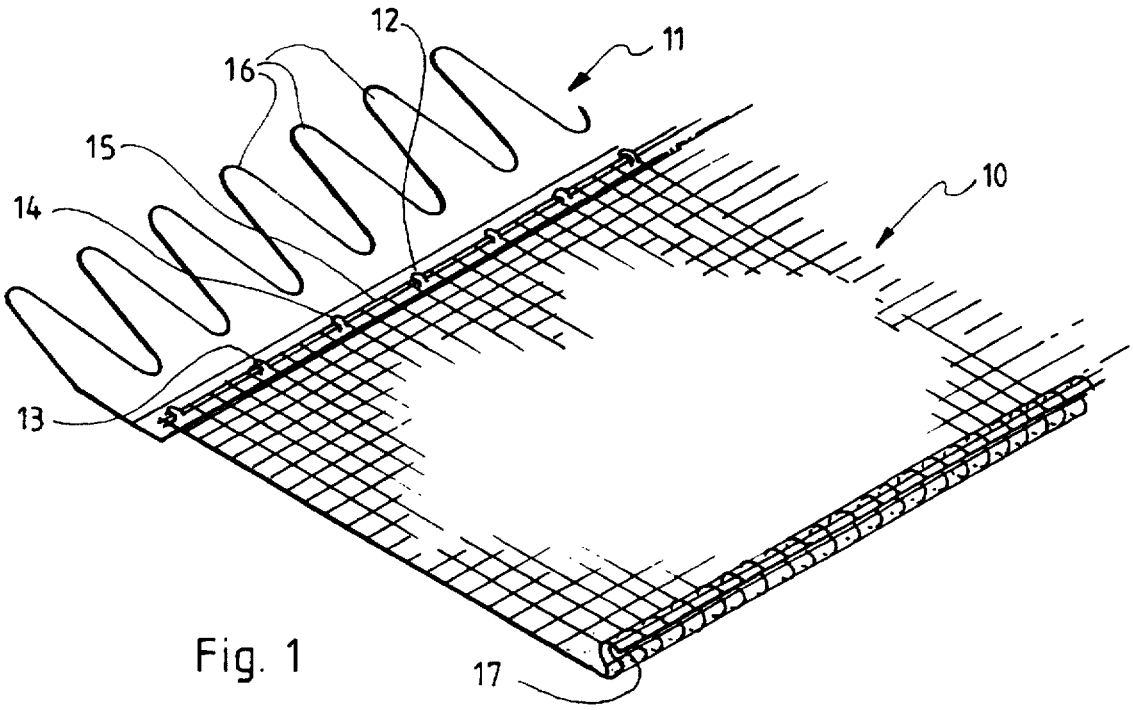
FIG. 1 is a perspective view of a mesh/flashing arrangement according to the present invention.

Referring firstly to FIG. 1, the mesh/flashing arrangement comprises a galvanized steel mesh 10 having square openings approximately 6 mm×6 mm in size, which is joined to a galvanized iron sheet metal flashing 11. The mesh is a weld mesh fabrication of 0.4 mm steel wire. The flashing is formed from 0.4 mm high tensile or galvanized steel, and includes a plurality of tongue extensions 16 projecting from one longitudinal edge thereof. The tongue extensions are smoothly contoured so as to form a snug fit between adjacent ridges of corrugations in the sheet roofing as described below.

The mesh 10 is joined to the flashing 11 by means of hooks 12, 13, 14 which are pressed out of the sheet material of the flashing and which are crimped over an edge wire 15 of the mesh. Such hooks are positioned so as to be located between the corrugated ridges of the roofing material when in situ.

The free edge 17 of the mesh 10 may be preformed so as to suit the particular profile of guttering it is to be used with. In this case it is rolled to suit an internal roll edge gutter.

In practice, the flashing 11 and mesh 10 will normally be sold as two separate items which are joined together either immediately before use or during placement. If the products are to be joined during placement, it is preferable to firstly lay the mesh in position with the free edge 17 curled into the gutter roll edge and then to pop rivet the flashing directly over the opposing edge of the mesh into the ridges of the corrugated sheet metal roof. This method obviates the need to separately join the mesh to the flashing and the flashing therefore need not incorporate the aforementioned hooks.

Figure 2:
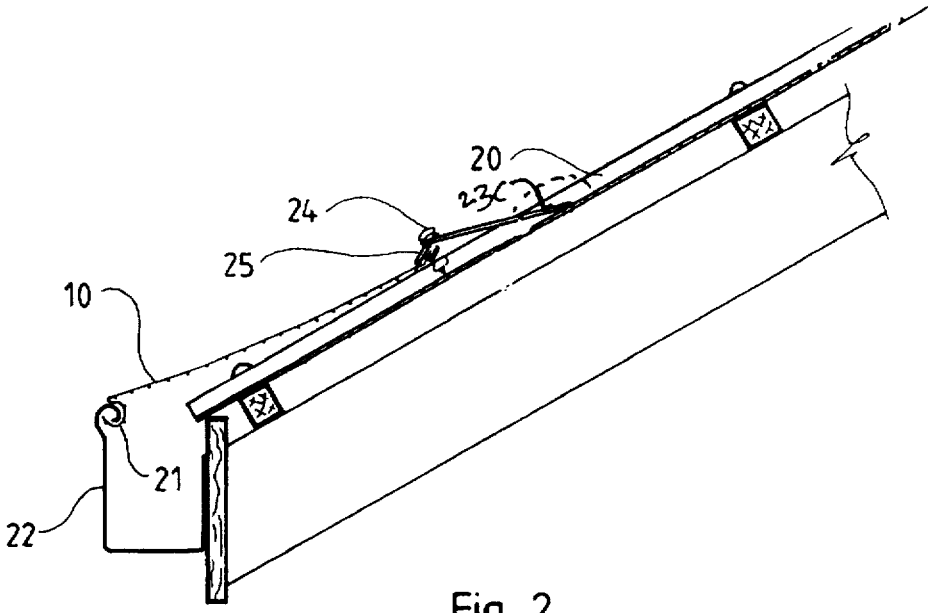
FIG. 2 is a cross-sectional view of the arrangement fitted to a corrugated sheet roof.
Figure 3:
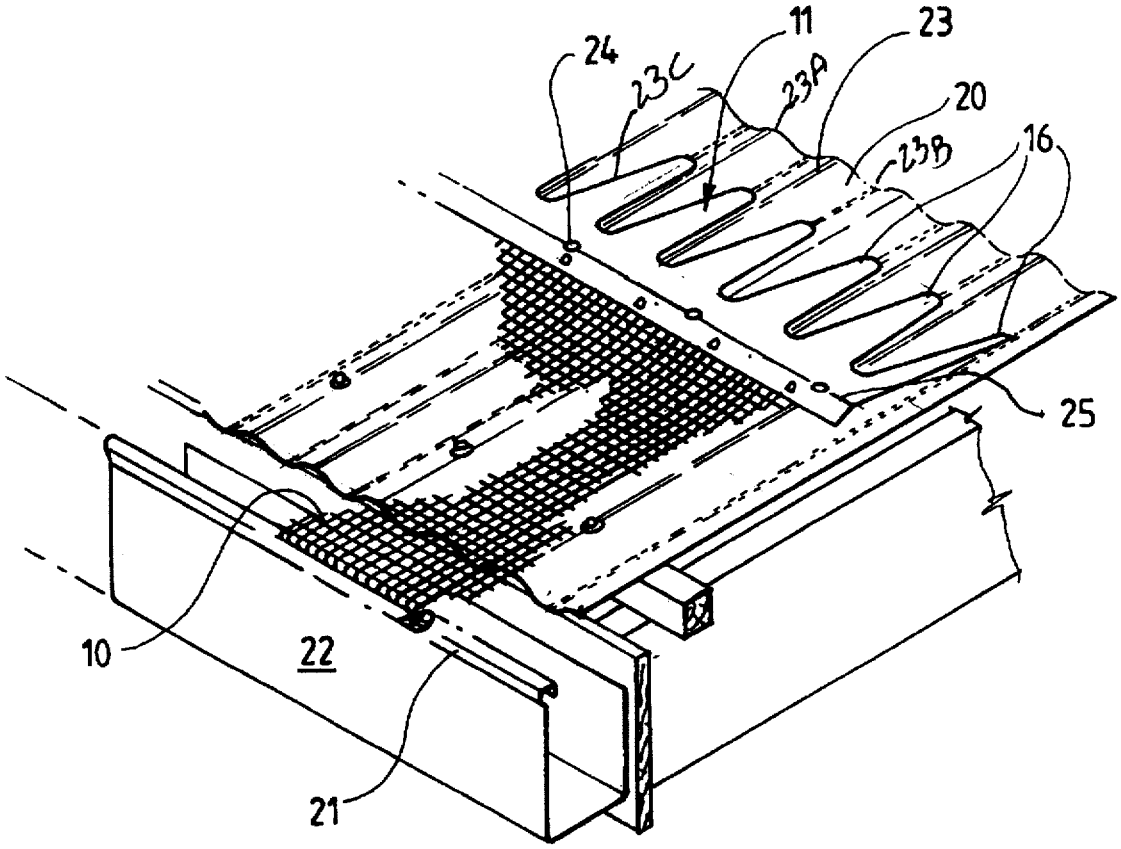
FIG. 3 is a perspective view of the arrangement depicted in FIG. 2.

Reference is now made to FIGS. 2 and 3 which show the arrangement in situ on a corrugated sheet metal roof 20.

The mesh 10 is captured along its free longitudinally extending edge 17 in the roll edge 21 of an internal roll-edge gutter 22, and is clamped between the flashing 11 and the ridges 23 adjacent the opposite edge thereof. The flashing 11 is fitted to the roof by means of pop rivets 24 extending through the ridges of the corrugated sheet roofing material. Fitting is such as to ensure a snug fit with the peaks 23A and channels 23B of the ridges 23, with a relatively smooth interface 23C at a relatively large obtuse angle of inclination relative to the sheet metal 20. Such snugness of fit is guaranteed by a slight ridge 25 formed in the flashing and through which the pop rivets 24 are inserted. That is, upon the pop rivets being inserted, the ridge 25 is urged toward the roof, causing the ridge to slightly flatten out and the tongue extensions 16 to be biased firmly against the bottom of the corrugations.

It will be readily apparent from the drawings that water with entrained debris and leaves can flow down the roof over the flashing in a substantially unimpeded manner. The relatively large area of mesh means that the debris and leaves collecting thereon will not impede the continued flow of water through the mesh into the gutter, and will provide a surface upon which the debris and leaves can dry out for collection or dispersion by the wind.

The arrangement as described is completely fire proof and meets all the objectives as previously described.

Whilst the above has been given by way of illustrative example of the invention, many modifications and variations may be made thereto by persons skilled in the art without departing from the broad scope and ambit of the invention as herein set forth.

I claim:

1. An arrangement for preventing leaves and debris from passing into guttering at a lower edge of a roof formed from corrugated sheet metal having a predetermined profile, said arrangement comprising a strip of mesh adapted to overly the guttering and also to overly a lower section of the corrugated sheet metal, and a flashing joined to one edge of the mesh and adapted to butt up against the corrugated sheet metal at a location spaced from the edge of the roof, said flashing including a plurality of tongue extensions projecting away from the mesh, each said tongue extension being adapted to extend from a respective pair of adjacent ridge peaks in the corrugated sheet metal to a bottom of a channel between said peaks to form a smooth large obtuse angle of inclination relative to the channel of the corrugated sheet metal, whereby when the mesh and the flashing are installed on the roof and on the guttering, the interface between a tip of each tongue extension and the bottom of the channel does not significantly impede the flow of rainwater with entrained leaves and debris.

2. An arrangement as claimed in claim 1, wherein the flashing is formed from 0.4 mm high tensile galvanized steel sheeting.

3. An arrangement as claimed in claim 1, wherein the flashing has a low level longitudinal fold adjacent a region where it is joined to the mesh, said longitudinal fold defining a low level ridge extending the length of the flashing.

4. An arrangement as claimed in claim 1, wherein the tongue extensions have a uniform sinusoidal configuration.

5. An arrangement as claimed in claim 1, wherein the flashing includes a plurality of pressed indents for catching on to a strand of the mesh to thereby join the flashing to the mesh.

6. An arrangement as claimed in claim 1, wherein the mesh is formed from 0.4 mm galvanized steel wire and has square apertures measuring approximately 6 mm×6 mm.

7. An arrangement as claimed in claim 1, wherein a second edge of the mesh is rolled and adapted to be firmly accommodated by a rolled edge formed in the guttering when said arrangement is fitted on a roof.

8. A roof comprising:

at least one sheet of corrugated metal defining a plurality of ridges and channels, a gutter adjacent an edge of the sheet of corrugated metal, a strip of mesh overlying the gutter and at least a portion of the sheet of corrugated metal, and a flashing having a first edge overlying and jointing a portion of said strip of mesh and a second edge butted up against the sheet of corrugated metal at a location spaced from said mesh, said flashing including a plurality of tongue extensions each having a tip extending snugly into a bottom of a respective one of said channels from a ridge on either side of said one channel, with a large obtuse angle between the flashing and the corrugated sheet metal, whereby the flashing will not significantly impede rainwater with entrained leaves and debris from flowing from the corrugated sheet metal towards the guttering, and whereby the mesh and the flashing will cooperate to prevent the entrained leaves and debris from passing into the guttering.

9. A roof as claimed in claim 8, wherein the flashing is formed from 0.4 mm high tensile galvanized steel sheeting.

10. A roof as claimed in claim 8, wherein the flashing has a low level longitudinal fold adjacent a region where it is joined to the mesh, said longitudinal fold defining a low level ridge extending the length of the flashing.

11. A roof as claimed in claim 8, wherein the tongue extensions have a uniform sinusoidal configuration.

12. A roof as claimed in claim 8, wherein the flashing includes a plurality of pressed indents for catching on to a strand of the mesh to thereby join the flashing to the mesh.

13. A roof as claimed in claim 8, wherein the mesh is formed from 0.4mm galvanized steel wire and has square apertures measuring approximately 6 mm×6 mm.

14. A roof as claimed in claim 8, wherein a second edge of the mesh is rolled and in intimate contact with a rolled edge formed in the guttering.

15. Flashing for use with mesh-covered guttering at a lower edge of a corrugated sheet metal roof, said flashing comprising:

opposing first and second longitudinal edges;

joining means for joining the first longitudinal edge to said mesh; and a plurality of tongue extensions projecting from the second longitudinal edge, each said tongue extension having a uniform sinusoidal configuration and being adapted to extend snugly between two adjacent ridges in the corrugated sheet metal at a smooth large obtuse angle from a respective peak of each ridge to a bottom of a channel between the ridges.

16. Flashing as claimed in claim 15, wherein the flashing is formed from 0.4 mm high tensile galvanized steel sheeting.

17. Flashing as claimed in claim 16, wherein said joining means includes a low level longitudinal fold which defines a low level ridge extending the length of the flashing.

18. Flashing as claimed in claim 16, wherein the joining means includes a plurality of pressed indents for catching on to a strand of the mesh.

* * * * *